US007086176B2

(12) United States Patent
Lin

(10) Patent No.: US 7,086,176 B2
(45) Date of Patent: Aug. 8, 2006

(54) HAIR DRYER HOT AIR GENERATOR RETAINER

(76) Inventor: Hsin-Yun Lin, PO Box 82-144, Taichung (TW)

( * ) Notice: Subject to any disclaimer, the term of this patent is extended or adjusted under 35 U.S.C. 154(b) by 98 days.

(21) Appl. No.: 10/960,911

(22) Filed: Oct. 12, 2004

(65) Prior Publication Data

US 2006/0075654 A1 Apr. 13, 2006

(51) Int. Cl.
*A45D 20/12* (2006.01)

(52) U.S. Cl. ..... 34/97; 392/382

(58) Field of Classification Search ..... 34/97, 34/98, 99, 100; 392/380, 384
See application file for complete search history.

(56) References Cited

U.S. PATENT DOCUMENTS 1,946,665 A * 2/1934 Bieth ..... 55/305
2,049,812 A * 8/1936 Loacker ..... 34/104
4,629,864 A * 12/1986 Wilson ..... 392/385
4,996,972 A * 3/1991 Poston ..... 126/263.01
5,909,535 A * 6/1999 Curwick et al. ..... 392/476
2005/0198764 A1* 9/2005 Heatley ..... 15/323

* cited by examiner

*Primary Examiner*—S. Gravini
(74) *Attorney, Agent, or Firm*—Leong C. Lei

(57) ABSTRACT

A hair dryer hot air generator retainer allowing compact design, production cost reduction, and see-through attractive appearance containing a built-in hot air generator in homogenous voltage drop design; including a barrel in two separate halves and an H shape frame; multiple vitreous hot air generation devices sandwiched by two retaining members adapted with relative electrodes also for conduction; all ends of conductors connected to a DC motor concealed inside the frame for hot air generation devices to achieve homogenous voltage drop for use.

4 Claims, 3 Drawing Sheets

HAIR DRYER HOT AIR GENERATOR RETAINER

BACKGROUND OF THE INVENTION (a) Technical Field of the Invention

The present invention is related to a hot air generator retainer in a hair dryer, and more particularly to a hollow "H" shape frame to conceal cord connection in conjunction with the stack of hot air generation device to achieve design purposes of being compact, practical, and attractive.

(b) Description of the Prior Art

A hair dryer operating on non-resistance wire of the prior art is essentially comprised of ceramic hot air generation device as the main portion of the hair dryer for generating hot air, such as the "Hair Dryer with IR" taught in Taiwan Patent Publication No. 355947. The hair dryer with IR is comprised of a barrel and a fan housing adapted with air inlet grill containing hot air generator and fan installed in a retainer comprised of plates alternatively arranged to retain the hot air generator, and the hot air generator is conducted by contacting the conducting silicon provided at both ends of the hot air generator while the cool air sucked into externally passing the hot air generator through the fan increase the temperature of the air. More particularly, it addresses that the entire hot air generation device is made of ceramic material that emits infrared light. The assembly is completed in the fashion of loading since the hot air generator is provided in the body and the body is prefabricated into a barrel. However, the material selected for the frame must be capable of withstanding high temperature and functioning as an insulator due to that the hot air generator related to a coating of conduction film is vulnerable to be damaged by contact and that the active hot air generator is at extremely high temperature. Otherwise, the hair dryer is exposed to electric shock. Furthermore, with the absence of a conventional resistance wire for voltage drop, a heavier AC motor is used instead resulting in a heavier hair dryer. The integrated barrel causes higher production cost and the assembly process and the positioning are comparatively difficult as the set of the hot air generation device is alternatively stacked to one another. All these make the hair dryer in use a burden for the user to hold.

SUMMARY OF THE INVENTION

The primary purpose of the present invention is to provide a retainer for a hot air generator in a hair dryer that is simple in construction, allowing a see-through attractive appearance of the hair dryer, easy assembly, reduced production cost, and improved safety. To achieve the purpose, an H shape frame is used to hold together two halves of the barrel of the hair dryer. Multiple vitreous hot air generation devices each in hollow tubes are concentrically overlapped to one another and held in place by the H frame. Furthermore, the cord is hidden in the barrel of the hair dryer.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
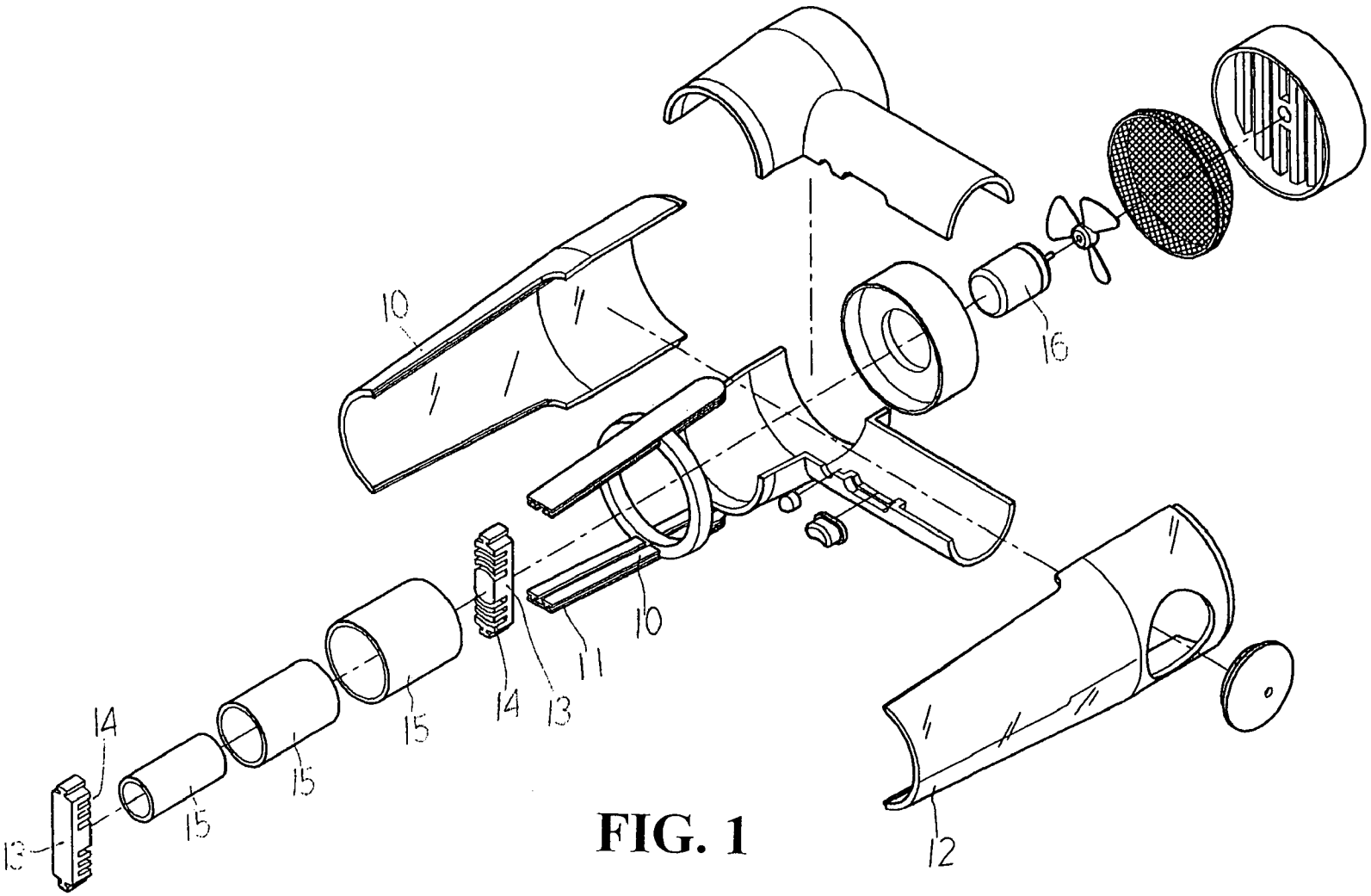
FIG. 1 is a perspective view of the present invention.
Figure 2:
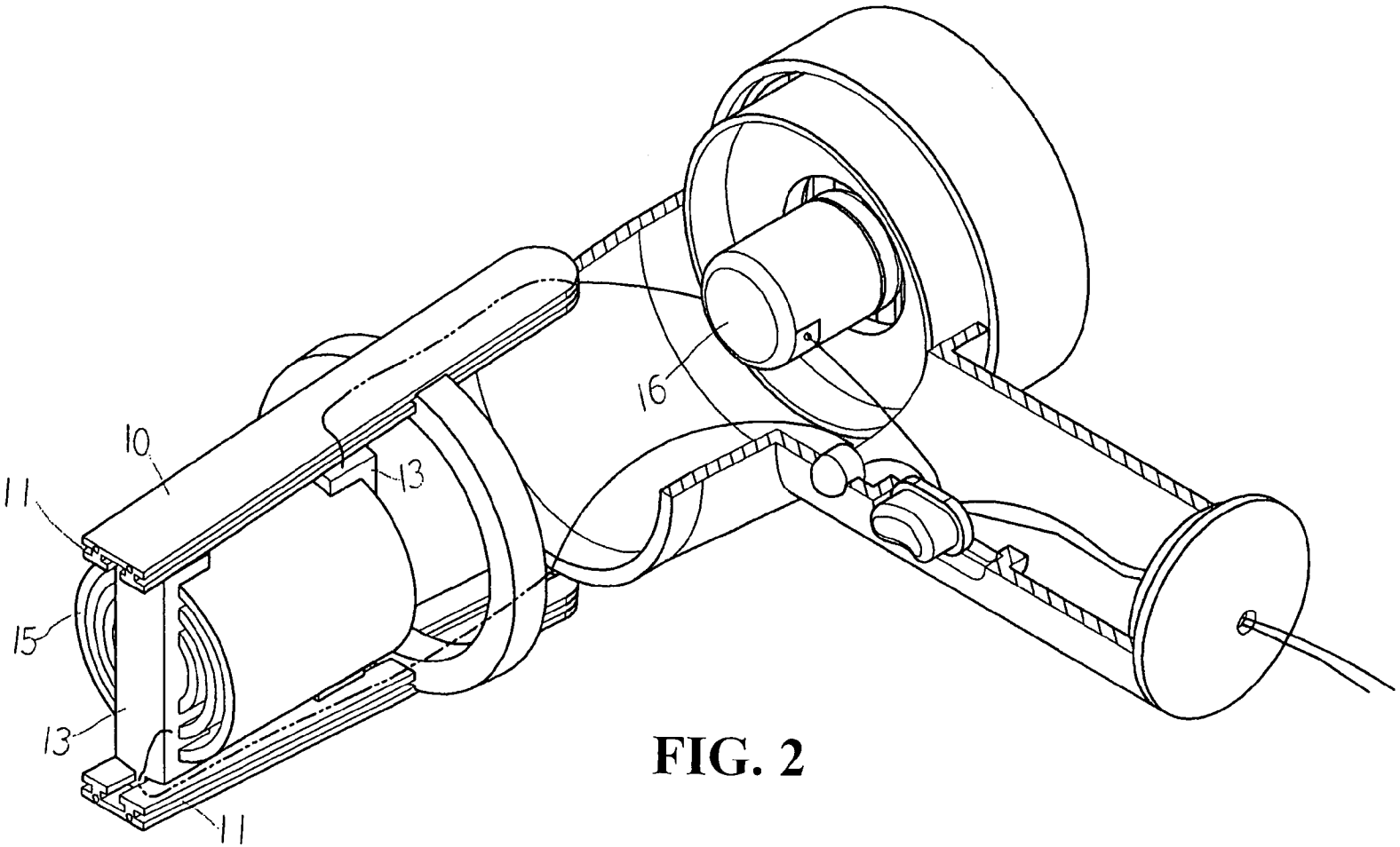
FIG. 2 is a sectional view of the present invention as assembled.
Figure 3:
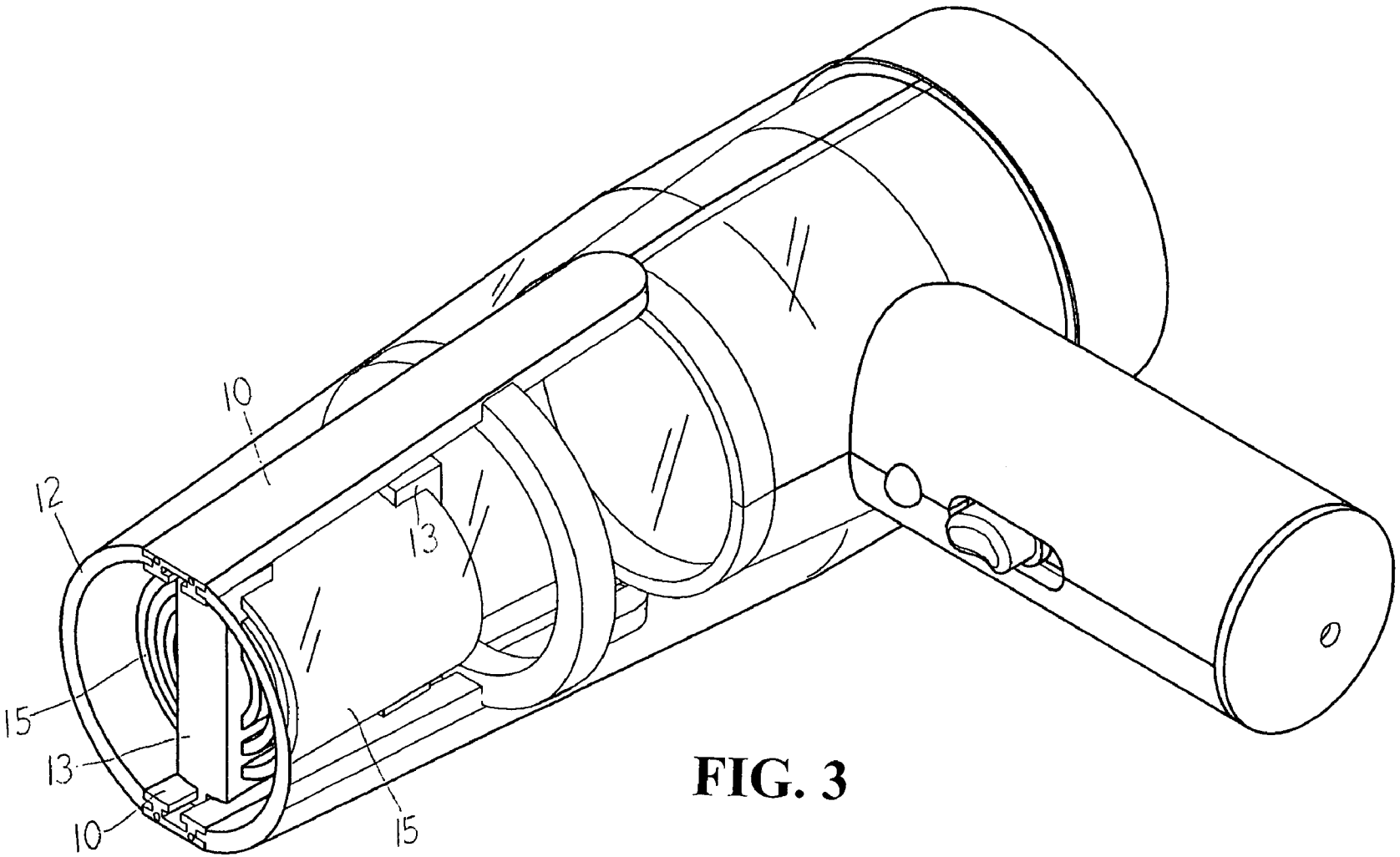
FIG. 3 is a schematic view showing a see-through air dryer of the present invention.

Referring to FIGS. 1, and 2, a preferred embodiment of the present invention is essentially comprised of a barrel (12) made into two identical halves and a retainer (10) in an H shape. The retainer (10) includes two locking tracks (11) to lock up the barrel (12). The barrel (12) is transparent, and careful selection of color scheme for the hair dryer will make it stylish and attractive. Two retaining posts (13) are provided each vertically to both locking tracks (11). Each retaining post (13) is provided on one side several grooves (14) for securing a set of hot air generation device (15) comprised of multiple hollow tubes made of vitreous material in a diameter different from one another and arranged concentrically. Each groove (14) is preset with a metal conduction member to conduct the set of the hot air generation device (15). A voltage drop device is incorporated to certain part of the set of the hot air generator device (15) to directly drop the voltage of a device to increase the temperature of the hot air. The post (13) is connected to where the motor (16) is located. The design of multiple tubes arranged concentrically provides significant increase of the heating area and effectively and directly promote the efficient delivery of hot air, thus eliminating the insufficient delivery of hot air observed with the prior art. H frame design for the retainer also helps significantly reduce the nonconformity of the production of the hot air generation device (15), and shorten the length of the hair dryer to achieve the purpose of being compact. The cord and the wiring for voltage drop are entirely concealed in the space defined by the retaining posts (13) and the retainer (10). Accordingly, the appearance of the hair dryer may be adapted with any attractive material for decoration purpose; each member of the hair dryer is secured in place to ensure use with safety and stable voltage; and the molding and assembly costs are reduced.

The present invention for providing a simple H-shape retainer to hold the barrel with the hot air generation device held in position by the retaining posts provides a simplified construction with reduced dimension for safe use of the healthy IR adapted to the hot air generation device is innovative and practical. Therefore, this application for a utility pattern is duly filed accordingly.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A hair dryer hot air generator retainer including a barrel, fan motor and hot air generation device built in the barrel; two retaining posts with each having on one side provided with multiple grooves; two locking tracks to lock up both posts at right angle; the hot air generation device sandwiched by both retaining posts being comprised of multiple tubes in diameter different from one another and arranged concentrically; both posts being directly connected to a DC motor to conduct the hot air generation device and serve the purpose of voltage drop for the motor.

2. The hair dryer hot air generator retainer of claim 1, wherein, the retainer is made in an H shape; the barrel is comprised of two identical halves; two locking tracks inserted with both retaining posts at right angle to hold both halves of the barrel inserted to each other.

3. The hair dryer hot air generator retainer of claim 1, wherein, the H shaped retainer is made in hollow to accommodate the cord when retracted.

4. The hair dryer hot air generator retainer of claim 1, wherein, a metal conduction metal member is preset and concealed among grooves of the retaining post.

* * * * *